US005572866A

United States Patent [19]

Loving

[11] Patent Number: 5,572,866

[45] Date of Patent: Nov. 12, 1996

[54] POLLUTION ABATEMENT INCINERATOR SYSTEM

[75] Inventor: Ronald E. Loving, North Kingstown, R.I.

[73] Assignee: Environmental Thermal Oxidizers, Inc., North Kingston, R.I.

[21] Appl. No.: 235,566

[22] Filed: Apr. 29, 1994

[51] Int. Cl.[6] ..... F01N 3/26

[52] U.S. Cl. ..... 60/274; 60/286; 60/298; 60/303

[58] Field of Search ..... 60/274, 286, 303, 60/298

[56] References Cited

U.S. PATENT DOCUMENTS

| | | | |
|---|---|---|---|
| Re. 33,118 | 11/1989 | Scheitlin et al. | 60/299 |
| 3,074,469 | 1/1963 | Babbitt et al. . | |
| 3,750,401 | 8/1973 | Nambu | 60/286 |
| 3,982,397 | 9/1976 | Laurent | 60/286 |
| 4,415,344 | 11/1983 | Frost et al. | 55/523 |
| 4,427,423 | 1/1984 | Montierth | 55/97 |
| 4,450,682 | 5/1984 | Sato et al. | 60/286 |
| 4,504,294 | 3/1985 | Brighton | 55/502 |
| 4,576,617 | 3/1986 | Renevot | 55/96 |
| 4,597,262 | 7/1986 | Retallick | 60/274 |
| 4,604,868 | 8/1986 | Nomoto et al. | 60/286 |
| 4,615,173 | 10/1986 | Toshifumi et al. | 60/286 |
| 4,625,511 | 12/1986 | Scheitlin et al. | 60/299 |
| 4,630,438 | 12/1986 | Shinzawa | 60/274 |
| 4,651,524 | 3/1987 | Brighton | 60/274 |
| 4,663,934 | 5/1987 | Sickels | 60/302 |
| 4,672,809 | 6/1987 | Cornelison | 60/286 |
| 4,711,087 | 12/1987 | Kawamura | 60/286 |
| 4,725,411 | 2/1988 | Cornelison | 422/180 |
| 4,785,748 | 11/1988 | Sujata et al. | 110/238 |
| 4,813,233 | 3/1989 | Vergeer et al. | 60/286 |
| 4,838,067 | 6/1989 | Cornelison | 72/196 |
| 4,887,426 | 12/1989 | Goerlich | 60/274 |
| 4,902,487 | 2/1990 | Cooper et al. | 423/215.5 |
| 4,915,038 | 4/1990 | Sujata et al. | 110/346 |
| 4,944,153 | 7/1990 | Goerlich et al. | 60/303 |
| 4,974,414 | 12/1990 | Kono et al. | 60/286 |
| 4,987,738 | 1/1991 | Lopez-Crevillen | 60/286 |
| 5,014,509 | 5/1991 | Broering et al. | 60/274 |
| 5,044,158 | 9/1991 | Goerlich | 60/274 |
| 5,052,178 | 10/1991 | Clerc et al. | 60/274 |
| 5,063,737 | 11/1991 | Lopez-Crevillen | 60/286 |

*Primary Examiner*—Douglas Hart

*Attorney, Agent, or Firm*—Russell & Russell; Gail M. Taylor-Russell

[57] ABSTRACT

The pollution abatement incinerator system removes pollutants effectively, efficiently and economically from a flow of exhaust gases. The system will virtually eliminate compounds such as oxides of nitrogen, hydrocarbons, carbon monoxide, odors and organic and inorganic particulates from the exhaust gases of internal combustion engines or other sources of combustion. The resonant incinerator directly eliminates the undesirable and harmful pollution of the exhaust. A recuperator, preferably with two stages is incorporated into the system for efficiently capturing and reusing heat from the incinerator to simultaneously heat fresh air being forced through the recuperator and into the incinerator. A fuel converter is used to vaporize fuel of almost any type and inject the vaporized fuel into a ring injector within the incinerator. The ring injector disperses the vaporized fuel within incinerator. The vaporized fuel in the incinerator chamber is then ignited. A controller senses the operational parameters of the incinerator to control fresh air, ignition and fuel supply to start the system and maintain proper operating temperatures within the incinerator so as to optimize the combustion efficiency and energy economy of the pollution abatement incinerator system.

17 Claims, 3 Drawing Sheets

POLLUTION ABATEMENT INCINERATOR SYSTEM

BACKGROUND OF THE INVENTION

The field of the present invention relates generally to the energy efficient and economical elimination of pollutants exhausted from a contained gaseous pollutant source and, more particularly, to an apparatus and method of virtually eliminating or significantly reducing pollutants exhausted from piston and rotary type internal combustion engines and from other sources that produce pollutants through the combustion of petroleum or organic fuels.

Attention is called to U.S. Pat. Nos.: 3,750,401; 4,785,748; 4,915,038; 5,014,509; 3,074,469; 5,052,178; 4,944,153; 4,887,426; 5,044,158; 4,576,617; 4,450,682; 4,987,738; 5,063,737; 4,902,487; 4,838,067; 4,672,809; 4,504,294; 4,725, 411; 4,651,524; 4,663,934; 4,625,511; Re. 33,118; 4,597,262; 4,974,414; 4,711,087; 4,615,173; 4,630,438; 4,427,423; 4,415,344; 4,813,233; and 4,604,868.

Reducing air pollution, particularly pollution from engine emissions and noxious odors from sources other than engine emissions, has become a strong environmental objective both in the United States and around the world. Because of worldwide tightening of pollution emission standards, inventors have continually tried to invent devices and methods that will meet these increasingly stringent standards. Many previous references that relate to methods and apparatus for incinerating hazardous materials and wastes, first trap particulates in a filtering device and then periodically burn the trapped particles to clean the filtering device, rather than continuously eliminating the particulates and other pollution. Other devices that attempt to directly eliminate pollution from exhaust using a canular like combustion chamber fail to significantly reduce pollutants because the device itself produces large amounts of pollutants and may be energy inefficient.

There remains a need for a device that can continuously eliminate virtually all compounds such as oxides of nitrogen, hydrocarbons, carbon monoxide, odors and organic and inorganic particulates from pollution exhausted from a contained pollution source, including combustion engines, while maximizing its energy efficiency.

SUMMARY OF THE INVENTION

The present invention overcomes the aforementioned problems by continuously eliminating virtually all pollution exhausted from a contained pollution source efficiently and inexpensively and is disclosed herein. The pollution abatement incinerator system causes pollution to be reduced to its base elements. The apparatus of the present invention and its method of use, virtually eliminates pollution such as hydrocarbons, nitrous oxides, carbon monoxide, particulates (such as carbon particles in the form of soot), and offensive odors while being energy efficient. This system, with minor modifications can be used to eliminate pollution from many different sources, including piston and rotary type internal combustion engines. The source of the pollutants can be an internal combustion engine such as, but not limited to those in cars, trucks, buses, boats and trains, but can also include pollution (including odors) emitted from devices that result in pollution of a gaseous flow other than combustion engines, such as, but not limited to, incinerators; restaurant and bakery stove exhaust; dry cleaners exhaust; automotive repair and paint shop exhaust; sewage treatment plant exhaust; power generating stations; and manufacturing facilities. The device is suitable for installation during original equipment manufacturing of the pollutant source (for example, during engine manufacturing and assembly process) and is also suitable for retrofit. In addition, when the pollution abatement incinerator system is attached to a host pollution source, there is no degradation of the host pollution source, no matter whether the pollution abatement incinerator system is turned on or off.

The baseline pollution abatement incinerator system includes an incinerator chamber, a recuperator, a fuel converter mechanism, an ignition mechanism, a fresh air blower mechanism and a controller mechanism along with other devices substantially as set forth in the Abstract.

In the present method, pollution in the form of exhausted gases is directed into the incinerator where the undesirable and harmful compounds in the exhausted gas are virtually eliminated. When polluted exhaust gases are injected into the incinerator chamber through an inlet pipe which is much smaller in diameter than the incinerator chamber, a sudden expansion occurs as the gases enter into the larger diameter incinerator chamber. This sudden expansion causes a round vortex primary turbulence zone to form inside the incinerator chamber. When the correct amount of fuel and fresh air is added to this primary turbulence zone, it will ignite and burn with a blue flame shaped like a toroid just inside the incinerator from where the exhaust input is located. This blue flame indicates near total combustion of the fuel being injected into the chamber. The ignited fuel and air mixture in the center of the toroidal turbulence zone is kept in place by the velocity of the incoming exhaust gases and fresh air and fuel as supplied. The flame in the center of the toroid turbulence produces heat that causes pollutants within the incinerator chamber to decompose to their natural elements.

A secondary turbulence zone within the incinerator chamber causes a turbulence flow from one end of the chamber to the other. This causes the heated gases to be retained in the elevated temperature of the incinerator chamber for a short period of time instead of being immediately exhausted through the output duct of the incinerator. This delay or "dwell time" provides for more complete combustion and decomposition through oxidation of pollutants. The time period for removal of the pollutant material from the gaseous flow inside the incinerator chamber varies depending on the size of the incinerator chamber and the velocity of the gases.

These primary and secondary turbulence zones within the incinerator act to increase the energy efficiency of the incinerator chamber through the thorough mixing of fuel and fresh air making it more than 99% energy efficient in its ability to totally consume the fuel and produce heat. For effective, efficient and economical removal of pollutants from exhaust, the operating temperature within the incinerator should range from between about 600° F. and about 1750° F. At the proper operating temperatures, fewer oxides of nitrogen are formed and carbon based compounds are reduced to their base elements. The selection of the most effective temperature for the virtual elimination of pollutants is dependent upon the type and concentration of pollutant exhaust.

The incinerator chamber will have a specific resonant frequency. The specific resonant frequency is dependent upon the diameter of the chamber, length of the chamber, temperature and velocity of the gases going through the chamber. When the resonant frequency is reached, maximum fuel efficiency of the pollution abatement incinerator system is achieved while the pollutants are virtually eliminated. The resonance of the chamber can be maintained by varying the velocity of the input fresh air and the amount of fuel to maintain the optimum temperature and pressure in the incinerator chamber. One or more temperature and pressure sensors are located within the incinerator.

The incinerator chamber can be made to be dynamic as well as static. A static incinerator chamber has no moving pads and the air velocity, fuel and gas density are varied to keep the pressure and temperature in the incinerator chamber constant. In a dynamic incinerator chamber, the inside geometry or size of the incinerator chamber can be varied to maintain the pressure and temperature within the incinerator chamber constant.

As an example, if the incinerator chamber is attached to a diesel engine, when the engine speeds up in RPM and produces more exhaust, the fresh air will be reduced to keep the static pressure of the incinerator chamber at resonance. Conversely, if the engine slows down in RPM the fresh air should be increased to maintain static pressure and temperature in the incinerator chamber. This ability to control the fuel and fresh air based on the incinerator temperature and pressure allows the incinerator chamber to be kept at its resonance frequency as the input gases change. Keeping the pollution abatement incinerator at its resonant frequency, allows the efficiency of the chamber in virtually eliminating pollutants to be in excess of 99%.

The system is housed in a metal shell containing an insulated material to contain heat and thereby improve system efficiency and economy.

A recuperator provides for the recovery of heat energy from the incinerator that would otherwise be thrown away. In its optimum mode, the recuperator is a two stage device. The first stage of the recuperator is connected to the output tube of the incinerator and is a longitudinal circular shaped pleated metal shell disposed within the system's housing and spaced inwardly from the housing to form an air passageway. This air passageway exists between the outer metal shell and the housing of the system. The optimal shape of the pleated metal shell is star shaped, which allows for more surface area for heat transfer, while allowing for the smooth flow of pressurized exhaust gases being expelled from the incinerator and the pressurized fresh air that absorbs heat as it travels over the outside of the pleated metal shell before entering the incinerator. The exhaust expelled from the incinerator flows through the interior of the pleated metal shell which captures heat from the incinerator chamber. This captured heat is transferred through the inner surface of the pleated metal shell to the outer surface of the pleated metal shell where the heat is absorbed by fresh air being forced through the air passageway by a blower device. Within the interior of the pleated metal shell of the recuperator, a number of deflectors are placed. These deflectors cause the virtually pollution free exhaust being expelled from the incinerator to be deflected into the folds of the inner pleats of the metal shell. This increases the heat absorbed and transferred through the inner surface of the shell to the outer surface of the shell and thereby increases the efficiency of the recuperator.

The blower mechanism is powered by a variable high speed electrical motor capable of providing enough fresh air to sustain the combustion process within the incinerator chamber. The blower blows fresh air through the air passageway disposed within the outer metal housing of the system, surrounding the first stage of the recuperator and the incinerator which causes the fresh air to be preheated by the excess heat that is captured by the inner pleated metal shell of the recuperator and is transferred from the incinerator.

The second stage of recuperation takes place in the air passageway surrounding the longitudinal axis of the incinerator between the housing of the system. Air blown into the passageway by the blower is heated and forced into a number of ducted passageways that run the length of the incinerator chamber and return to the air inlet at the front end of the incinerator chamber. This additional preheating of the fresh air using the residual heat from the incinerator chamber results in less fuel required to raise the temperature of the ambient air used in the combustion process within the incinerator resulting in less energy being expended to maintain the operating temperature of the incinerator chamber.

The fuel converter acts as a fuel preheater and a fuel injector. It is an electromechanical device used to convert any fuel from a liquid to a vapor prior to being injected into the incinerator chamber. The fuel converter heating element is not needed when the fuel to be used by the incinerator chamber is already in a gaseous state. Without the fuel converter heating element, only fuel already in a gaseous state could be used to start the incinerator. Once the incinerator temperature is sufficiently high enough, the fuel converter heating element may be turned off and fuel is directly input into the incinerator. When the heating element is turned off, the fuel is heated by a ring injector located inside the incinerator. The ring injector is a hollow cylindrical device that receives liquid or vaporized fuel from the fuel converter and further heats it and continually injects the fuel around the inside perimeter of the incinerator chamber. The fuel is expelled from the ring injector into the toroidal turbulent area of the incinerator chamber system and is ignited by the ignition mechanism.

The controller senses the operational parameters of the incinerator chamber by using one or more sensing devices. The controller monitors, via thermal, pressure and/or magnetic sensors, the operational characteristics of the incinerator chamber. Also monitored are fuel used in the combustion process, the pressure of the incinerator chamber, the engine exhaust input, and the fresh air input. It will also monitor the functioning of the high voltage ignition mechanism and the fuel supply. The controller controls the startup sequence by initializing the fuel converter mechanism, then issuing instructions to the blower mechanism, ignition mechanism and the fuel supply to maintain the proper operating temperatures within the incinerator. Depending upon the load being exhausted into the incinerator chamber, the controller adjusts the input levels of fresh air from the blower mechanism and fuel from the fuel supply to maintain the proper operating temperature and pressures within the incinerator chamber to sustain the resonance condition of the incinerator. In addition, at system startup and during system operation, the controller has the ability to run diagnostic routines on the pollution abatement incinerator system to ensure its proper operation. These diagnostics may result in the identification of any problems within the pollution abatement incinerator system.

The ignition provides for initial startup of the incinerator chamber. The ignition is composed of a glow plug, spark plug or similar device within the incinerator that is activated by the controller upon startup of the system. Once the incinerator chamber is started, the ignition is turned off by the controller unit. Ignition type can be a spark plug type, a glow plug ignition type device or the like.

The pollution abatement incinerator system can be installed as a retrofit or add-on device to an existing pollution source, such as an automobile engine without degradation of the performance of the host system. The system is also suitable for manufacture as part of an original equipment manufacturing system, also without degradation of the host system. The device is suitable for installation on stationary and mobile sources of pollution. The device can use almost any fuel in a liquid or gaseous state.

DETAILED DESCRIPTION

Figure 1:
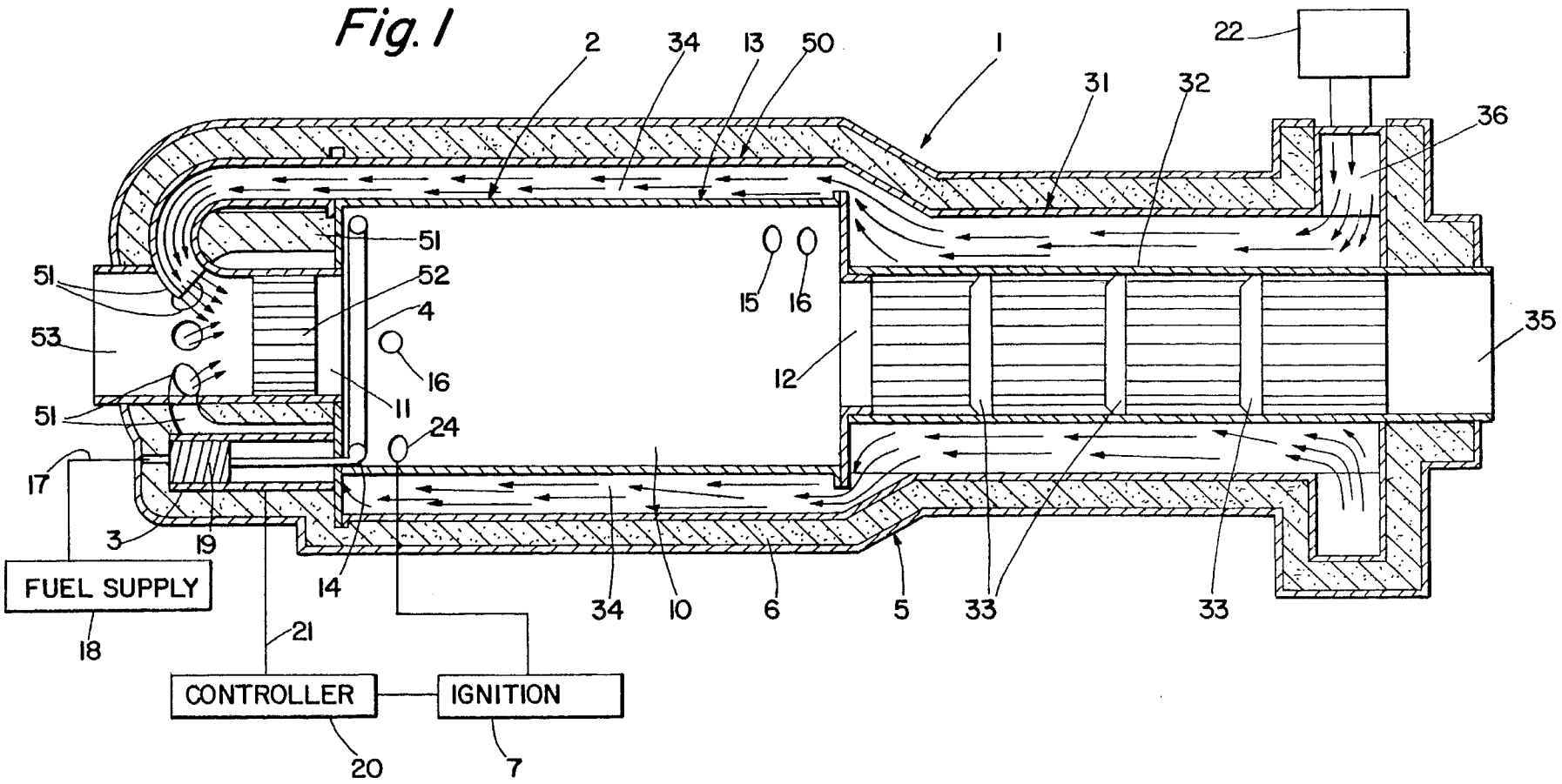
FIG. 1 is a diagrammatic representation of a sectional view of a preferred embodiment of the pollution abatement incinerator system.

Turning now to FIG. 1, a preferred embodiment of the pollution abatement incinerator system 1, is shown in accordance with the present inventive concepts. The system has an outer housing 5 of metal material and disposed within the housing is a layer of insulating material 6. The incinerator 2 disposed within the housing 5 and spaced inward, is shown, which comprises a cylindrical shaped incinerator chamber 10 for heating exhaust gases to a temperature sufficient to eliminate virtually all pollutant material within the exhaust gases, the chamber having an inlet duct 11 on one end and an exhaust outlet duct 12 on the opposite end of the chamber to expel the virtually pollutant free exhaust. The incinerator housing 13 is comprised of steel or a high temperature ceramic. There is a fuel input duct 14, adjacent to the ring injector 4. The ring injector 4 is located just inside the incinerator chamber 10 near the inlet duct 11. A pressure sensor 15 is disposed within the incinerator chamber 10. Temperature sensors 16 are disposed within the incinerator chamber 10.

The fuel input duct 14 is connected to the fuel converter 3 by a fuel supply line 17. The fuel supply line 17 is connected to a fuel supply 18. The fuel converter 3 also contains a heating element 19. The fuel converter 3 is connected to the controller 20 by a wire interface 21.

The controller 20 is connected to the temperature sensors 16 and the pressure sensor 15 within the incinerator combustion chamber 10. The controller 20 is also connected to the ignition component 7. The controller 20 is connected to the blower 22.

The ignition component 7 is connected by a wire interface to a spark plug or glow plug 24 inside the incinerator chamber 10.

The incinerator exhaust output duct 12 connects to the first stage of the recuperator 31 disposed within the system housing 5. The opposite end of the recuperator 31 ends in an exhaust tube 35. The first stage of the recuperator 31 contains a longitudinal star-shaped pleated shell 32 which contains multiple deflectors 33. An air plenum passageway 34 surrounds the pleated shell 32 and has an inlet duct 36 connected to a blower 22.

The air plenum passageway 34 continues over the top of the star-shaped pleated shell 32 and into the second stage of the recuperator 50, that surrounds the incinerator housing 13. The air plenum passageway 34 connects a bundle of air tubes 51 which in turn connect to an input tube 53 which contains an air diffuser 52. The input tube 53 connects to the inlet duct 11 of the incinerator chamber 10.

Fresh heated air is channeled from the air plenum passageway 34 into the ducted tubes 51. The fresh heated air in the ducted input tubes 51 is returned to the input tube 53 which passes the fresh heated air into the incinerator. Exhaust from the pollution source is input to the incinerator through the input tube 53.

Figure 2A:
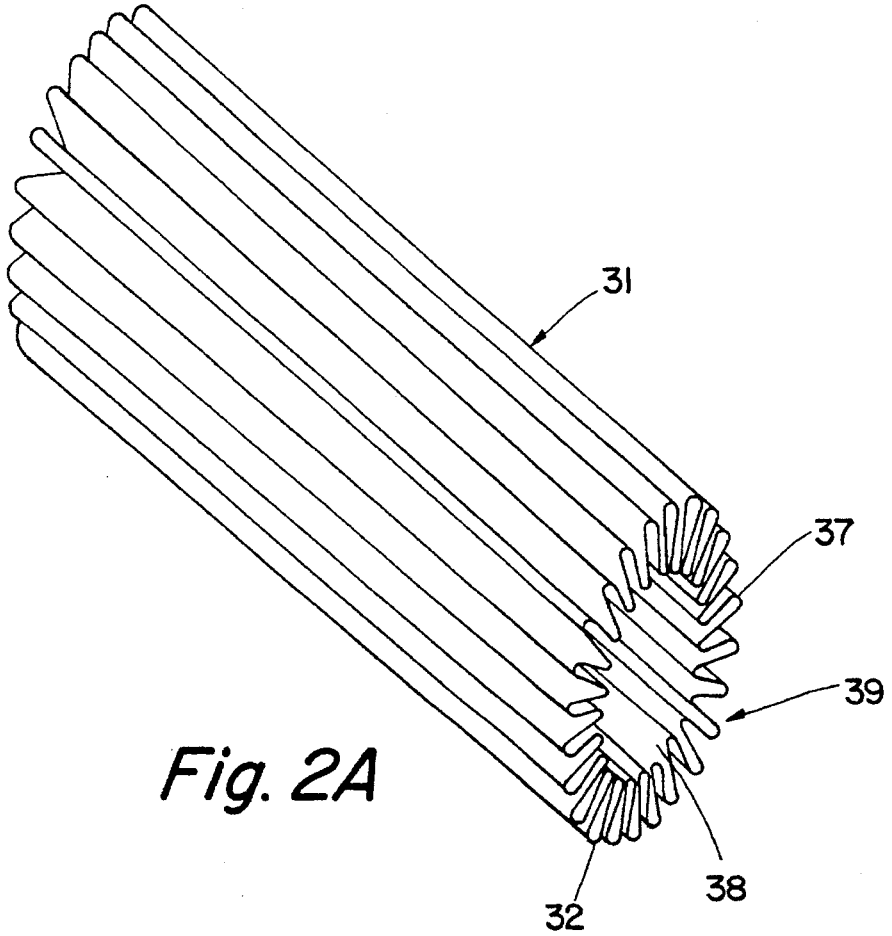
FIG. 2A is a diagrammatic representation of an isometric elevation of the first stage of the recuperator.
Figure 2B:
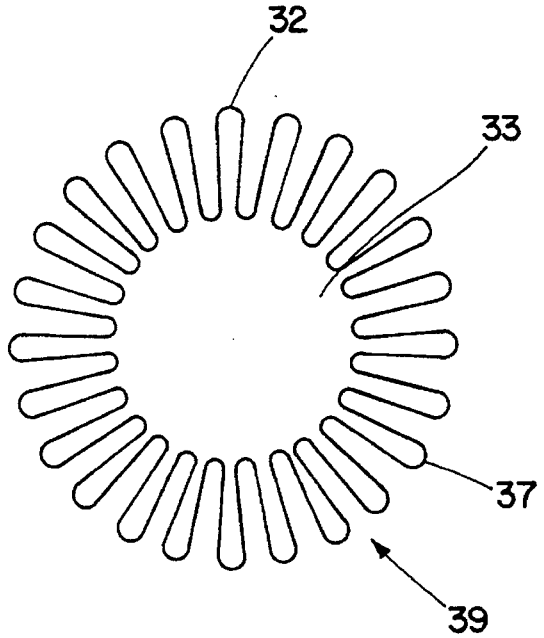
FIG. 2B is a side view of one end of the first stage of the recuperator.

The star shaped pleated shell 32 is shown in FIG. 2A with an inner surface 38 and an outer surface 37. FIG. 2B shows an end view 39 of the star shaped pleated shell.

Figure 3:
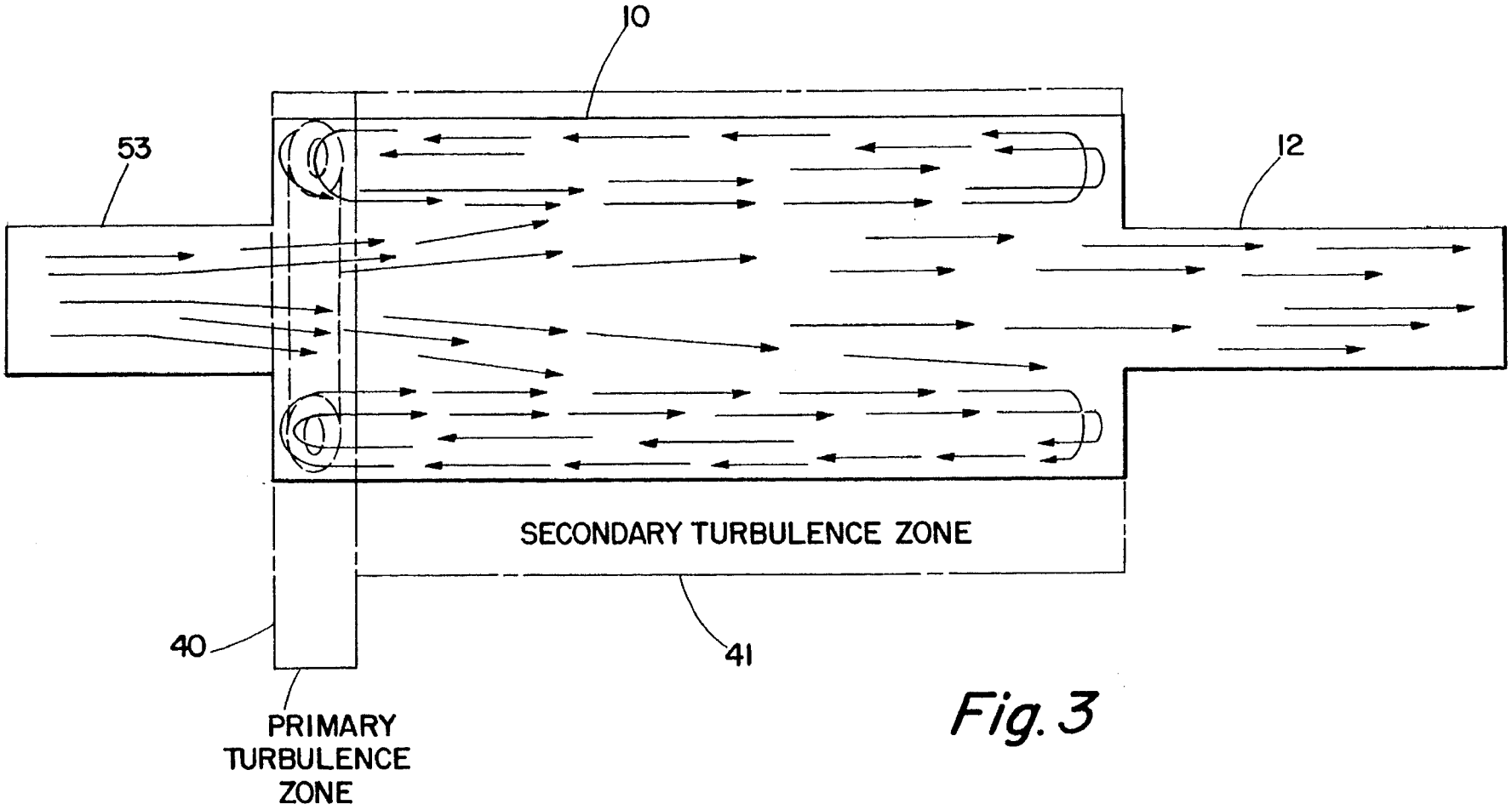
FIG. 3 is a diagrammatic representation of a side view of the incinerator showing the primary and secondary toroidal turbulence zones.

Turning now to FIG. 3, the primary torus turbulence zone 40 within the incinerator chamber 10 is shown along with the secondary turbulence zone 41.

In practicing the present invention, power is first applied to the controller 20. The controller will start the blower device 22 and the fuel converter heating element 19. The controller 20 will read the temperature sensors 16 within the incinerator chamber 10. Once the controller has determined the heating element 19 in the fuel converter 3 has reached the correct temperature, the controller activates the flow of fuel from the fuel supply 18 through the fuel supply line 17. The vaporized fuel is injected into the incinerator chamber 10. The controller applies power to the ignition mechanism 7 which in turn activates the glow plug or spark plug 24 to ignite the vaporized fuel in the incinerator chamber 10. When the incinerator chamber 10 temperature has reached a certain temperature as indicated by the temperature sensors 16, the controller may turn off the heating element 19 of the fuel converter 3. Fuel from the fuel supply 18 will be injected into the ring injector 4 within the incinerator chamber 10 without being heated by the fuel converter 3. Once the desired temperature is reached, the controller will maintain that temperature by controlling the fuel supply 18 and fresh air blown by the blower 22 to the chamber. The recuperator first stage 31 transfers excess heat from the star shaped pleated shell 32 to the air in the air plenum passageway 34. The second stage of the recuperator 50 transfers excess heat from the incinerator chamber 10 to the fresh air in the air plenum passageway 34. This fresh heated air is forced into the air tubes 51 surrounding the incinerator chamber 10, into the input tube 53, through the air input diffuser 52 and into the inlet duct 11.

Exhaust from a pollution source is input to the system via the input tube 53. It passes into the incinerator chamber 10. As shown in FIG. 3, a sudden expansion occurs and causes a round vortex primary turbulence zone 40 to form just inside the incinerator chamber 10. A secondary turbulence zone 41 is formed within the incinerator chamber 10. The heated exhaust gas is retained for a short time within the secondary turbulence zone 41 before being exhausted through the incinerator exhaust tube 12.

The controller will sample the pressure sensor 15 and the temperature sensor 16 within the incinerator chamber 10 and adjust the amount of fuel supply 18 and fresh air from the blower 22 to maintain the operating temperature of the chamber 10.

EXAMPLE

Computer math model analysis and physical experiments for the verification of the capability of the pollution abatement incinerator system have been conducted. Math model analysis indicates that the pollution abatement incinerator system will reduce hydrocarbons to almost zero and indicate that carbon dioxide and nitrous oxides are controllable based on the temperatures in the chamber and the fuel use. The computer math model also indicates that the best results would be achieved by using diesel fuel with large amounts of air. Preliminary results of the physical testing of the incinerator chamber provide verification of the predictions of the math model. Using propane as the fuel for the chamber, a test was conducted to try to achieve the lowest hydrocarbon count possible. During the physical testing, a count of 4.4 parts per million of hydrocarbons was achieved along with an nitrous oxide count of 67 parts per million. During another test, a hydrocarbon count of 2.8 parts per million was achieved with an nitrous oxide count of 70.2 parts per million. Both tests were conducted with a 4 cylinder diesel engine running at 1100 rpm. The chamber used for the testing was about 4.5 inches diameter and about 12 inches in length. The temperature in the incinerator varied from between about 1600° F. and about 1750° F.

What is claimed is:

1. A pollution abatement incinerator system, to continuously remove pollutants from a flow of a gaseous mixture, comprising:

a. an outer housing of metal;

b. an interior insulating layer disposed within the outer housing;

c. an incinerator spaced inwardly from the interior insulating layer within the outer housing with a chamber for heating, an inlet duct for receiving fresh air and exhaust from a pollution source, and an output duct that expels exhaust in which virtually all the undesirable and harmful compounds have been eliminated by the application of sufficient heat within the incinerator;

d. the incinerator chamber operates at a temperature of between about 600° to about 1750° F.;

e. a recuperator within the interior insulating layer within the outer housing and surrounding the incinerator to provide an air passageway to enable the recovery of waste heat from the incinerator, said recuperator also extends rearward of the incinerator to recover heat from the hot exhaust exiting from the incinerator;

f. a forced fresh air supply mechanism connected to the outer housing which forces air through the air passageway of the recuperator into the incinerator;

g. a fuel injection and heating mechanism, connected to a fuel supply, for vaporizing fuel and injecting the vaporized fuel into the incinerator chamber, comprising a ring injector disposed just inside the input duct of the incinerator which receives vaporized fuel, further heats it and disperses and expels the vaporized fuel into the incinerator chamber and a fuel converter, connected to a fuel supply line, containing a heating element, that injects vaporized fuel into the ring injector;

h. an ignition mechanism which ignites the vaporized fuel in the incinerator chamber on initial system startup; and i. a controller connected to the outer housing which senses the temperature and pressure within the incinerator and issues instructions to the forced fresh air supply mechanism, the fuel injection and heating mechanism, and the ignition mechanism, to initialize the incinerator and maintain proper operating temperatures within the incinerator.

2. A pollution abatement incinerator system to continuously remove pollutants from a flow of a gaseous mixture, comprising:

a. a cylindrical shaped incinerator with a chamber for heating exhaust gases to a temperature sufficient to eliminate virtually all pollutant material within the exhaust gases, the chamber having an inlet duct on one end which is smaller in diameter than the chamber and an outlet mechanism on the opposite end of the chamber to expel the virtually pollutant free exhaust, the chamber having an air intake inlet, a fuel injection and heating mechanism connected to a fuel line inlet, a fuel ignition mechanism, a pressure sensor, and a temperature sensor;

b. the chamber of the incinerator, when the fuel and air are ignited, contains a primary torus turbulence zone that results in a blue flame shaped like a toroid, adjacent to the exhaust inlet duct, the blue flame indicating that almost total combustion is occurring inside the incinerator chamber, and a secondary turbulence zone flowing from one end of the incinerator to the opposite end, causing the heated gas to be retained for a short time in the incinerator chamber before being expelled;

c. the incinerator chamber operates at a temperature of between about 600° to about 1750° F.;

d. a two stage recuperator with a first stage that is placed rearward of the outlet duct of the incinerator and receives the exhaust expelled from the incinerator, the first stage having a longitudinal metal shell formed with an inner and outer surface area whereby the heat from the incinerator exhaust is transferred through the inner surface of the metal shell to the outer surface of the metal shell, the first stage having an exhaust tube on the opposite end of the end adjacent to the incinerator, and a second stage that surrounds the incinerator with a tubular shaped passageway contained within an outer shell having an air intake mechanism, channeling the heated air absorbed from the incinerator and the first stage of the recuperator to the inlet duct of the incinerator chamber;

e. said fuel injection and heating mechanism, connected to a fuel supply for injecting vaporized fuel into the incinerator chamber;

f. said ignition mechanism which ignites the vaporized fuel in the incinerator chamber on initial system startup;

g. said fresh air supply mechanism; and h. a controller which senses the pressure and temperature within the incinerator chamber and issues commands to the fresh air supply mechanism, the fuel injector and the ignition mechanism to initialize and maintain proper operating temperatures within the incinerator chamber.

3. A pollution abatement incinerator system according to claim 1, wherein the incinerator comprises an incinerator which maintains a resonant frequency depending upon the chamber diameter, chamber length, temperature within the chamber, and the velocity of the fresh air and exhaust within the chamber, thereby maximizing the pollution abatement process and the fuel efficiency of the incinerator.

4. A pollution abatement incinerator system according to claim 2, wherein the incinerator comprises an incinerator which maintains a resonant frequency depending upon the chamber diameter, chamber length, temperature within the chamber, and the velocity of the fresh air and exhaust within the chamber, thereby maximizing the pollution abatement process and the fuel efficiency of the incinerator.

5. A pollution abatement incinerator system according to claim 4, wherein the longitudinal metal shell within the first stage of the recuperator comprises star-shaped pleats whereby the heat from the incinerator exhaust is transferred through the inner surface of the metal shell to the outer surface of the metal shell, and contains a number of deflector inserts to cause the exhaust from the incinerator to be deflected into the star-shaped pleats.

6. A method of using a pollution abatement incinerator system, to continuously remove virtually all pollutants from a flow of a gaseous mixture, comprising the steps of:

a. forcing fresh air into the inlet duct of the incinerator;

b. injecting vaporized fuel into the incinerator chamber;

c. igniting the fuel and air mixture within the incinerator chamber;

d. receiving exhaust from a pollution source into the inlet duct of the incinerator;

e. heating the incinerator chamber to an operating temperature of between about 600° to about 1750° F., suddenly expanding the fuel, air and exhaust to form a primary torus turbulence zone that results in a blue flame shaped like a toroid inside the chamber adjacent to the exhaust inlet duct indicating that almost total combustion is occurring and a secondary turbulence zone flowing from one end of the incinerator to the opposite end, causing the heated gas to be retained for a short time in the incinerator chamber before being expelled;

f. passing the exhaust from a pollution source through the incinerator chamber for a time sufficient to virtually eliminate al the undesirable and harmful compounds within the exhaust from a pollution source and then expelling the exhaust out of the incinerator;

g. recovering heat from the exterior of the incinerator chamber and from the exhaust being expelled from the incinerator to preheat the fresh air being forced into the inlet duct of the incinerator using a recuperator spaced outwardly and surrounding the incinerator to form an air passageway for the transfer of heat; and h. sensing the temperature and pressure within the incinerator and issuing instructions to the forced air mechanism, the ignition mechanism and the fuel injector to sustain proper operating temperatures within the incinerator.

7. A method of using a pollution abatement incinerator system according to claim 6, wherein the fuel injecting and igniting step comprises:

a. receiving vaporized fuel into a ring injector disposed just inside the input duct of the incinerator further heating it, dispersing and expelling the vaporized fuel into the incinerator chamber; and b. heating fuel to a vapor by a fuel converter, connected to a fuel supply line, containing a heating element and injecting the vaporized fuel into the ring injector within the incinerator.

8. A method of using a pollution abatement incinerator system, to continuously remove virtually all pollutants from a flow of a gaseous mixture, comprising the steps of:

a. forcing fresh air into the inlet duct of the incinerator;

b. injecting vaporized fuel into the incinerator chamber;

c. igniting the fuel and air mixture within the incinerator chamber;

d. receiving exhaust from a pollution source into the inlet duct of the incinerator;

e. heating the incinerator chamber to an operating temperature of between about 600° to about 1750° F.;

f. passing the exhaust from a pollution source through the incinerator chamber for a time sufficient to virtually eliminate al the undesirable and harmful compounds within the exhaust from a pollution source and then expelling the exhaust out of the incinerator;

g. recovering heat from the exterior of the incinerator chamber and from the exhaust being expelled from the incinerator to preheat the fresh air being forced into the inlet duct of the incinerator using a recuperator spaced outwardly and surrounding the incinerator to form an air passageway for the transfer of heat by passing the exhaust through a two stage recuperator with a first stage that is placed rearward of the outlet duct of the incinerator to receive exhaust expelled from the incinerator, the first stage having a longitudinal metal shell formed with an inner and outer surface area whereby the heat from the incinerator exhaust is transferred through the inner surface of the metal shell to the outer surface of the metal shell and to the air in the air plenum passageway, the first stage having an exhaust tube on the opposite end of the end adjacent to the incinerator, and transferring heat to fresh air forced through a second stage that surrounds the incinerator with a tubular shaded passageway contained within an outer shell, channeling the heated air into the inlet duct of the incinerator chamber; and h. sensing the temperature and pressure within the incinerator and issuing instructions to the forced air mechanism, the ignition mechanism and the fuel injector to sustain proper operating temperatures within the incinerator.

9. A method of using a pollution abatement incinerator system according to claim 8, wherein the recovering heat step further comprises passing the exhaust through the longitudinal metal shell within the recuperator having star-shaped pleats whereby the heat from the incinerator exhaust is transferred through the inner surface of the metal shell to the outer surface of the metal shell, and containing a number of deflector inserts to cause the exhaust from the incinerator to be deflected into the star-shaped pleats thereby enhancing the heat recovery process.

10. A pollution abatement incinerator system according to claim 1, wherein the recuperator placed rearward of the incinerator to recover heat comprises a longitudinal metal shell with star-shaped pleats whereby the heat from the incinerator exhaust is transferred through the inner surface of the metal shell to the outer surface of the metal shell, and contains a number of deflector inserts to cause the exhaust from the incinerator to be deflected into the star-shaped pleats.

11. A pollution abatement incinerator system according to claim 1, wherein the fuel converter comprises:

a. a heating element that may be turned off when the ring injector is at a temperature sufficient to vaporize the fuel; and b. a heating element that may be turned on when the ring injector is not at a temperature sufficient to vaporize the fuel.

12. A pollution abatement incinerator system according to claim 1, wherein the incinerator chamber comprises a sudden expansion burden which causes a round vortex primary turbulence zone to form inside the incinerator chamber and causes a secondary turbulence zone to form and flow back and forth from one end of the incinerator chamber to the other.

13. A pollution abatement incinerator system according to claim 1, wherein the incinerator comprises an incinerator which maintains a resonant frequency depending upon the chamber diameter, chamber length, temperature within the chamber, and the velocity of the fresh air and exhaust within the chamber, thereby maximizing the pollution abatement process and the fuel efficiency of the incinerator.

14. A pollution abatement incinerator system according to claim 2, wherein the incinerator comprises an incinerator which maintains a resonant frequency depending upon the chamber diameter, chamber length, temperature within the chamber, and the velocity of the fresh air and exhaust within the chamber, thereby maximizing the pollution abatement process and the fuel efficiency of the incinerator.

15. A pollution abatement incinerator system according to claim 1, wherein the recuperator placed rearward of the incinerator comprises a longitudinal metal shell with star-shaped pleats whereby the heat from the incinerator exhaust is transferred through the inner surface of the metal shell to the outer surface of the metal shell, and contains a number of deflector inserts to cause the exhaust from the incinerator to be deflected into the star-shaped pleats.

16. A pollution abatement incinerator system according to claim 1, further comprising an incinerator having no moving parts.

17. A pollution abatement incinerator system kit to continuously remove pollutants from a flow of a gaseous mixture, comprising:

a. a cylindrical shaped incinerator with a chamber for heating exhaust gases to a temperature sufficient to eliminate virtually all pollutant material within the exhaust gases, the chamber having an inlet duct on one end which is smaller in diameter than the chamber and an outlet duct on the opposite end of the chamber to expel the virtually pollutant free exhaust, the chamber having an air intake inlet, a fuel injection and heating mechanism connected to a fuel line inlet, a fuel ignition mechanism, a pressure sensor, and a temperature sensor;

b. the chamber of the incinerator, when the fuel and air are ignited, contains a primary torus turbulence zone that results in a blue flame shaped like a toroid, adjacent to the exhaust inlet duct, the blue flame indicating that almost total combustion is occurring inside the incinerator chamber, and a secondary turbulence zone flowing from one end of the incinerator to the opposite end, causing the heated gas to be retained for a short time in the incinerator chamber before being expelled;

c. the incinerator chamber operates at a temperature of between about 600° to about 1750° F.;

d. a two stage recuperator with a first stage that is placed rearward of the outlet duct of the incinerator and receives the exhaust expelled from the incinerator, the first stage having a longitudinal metal shell formed with an inner and outer surface area whereby the heat from the incinerator exhaust is transferred through the inner surface of the metal shell to the outer surface of the metal shell, the first stage having an exhaust tube on the opposite end of the end adjacent to the incinerator, and a second stage that surrounds the incinerator with a tubular shaped passageway contained within an outer shell having an air intake mechanism, channeling the heated air absorbed from the incinerator and the first stage of the recuperator to the inlet duct of the incinerator chamber;

e. a fuel injection and heating mechanism, connected to a fuel supply for injecting vaporized fuel into the incinerator chamber;

f. an ignition mechanism which ignites the vaporized fuel in the incinerator chamber on initial system startup;

g. a fresh air supply mechanism; and h. a controller which senses the pressure and temperature within the incinerator chamber and issues commands to the fresh air supply mechanism, the fuel injector and the ignition mechanism to initialize and maintain proper operating temperatures within the incinerator chamber.

* * * * *